US010419859B2

(12) United States Patent
Singer et al.

(10) Patent No.: US 10,419,859 B2
(45) Date of Patent: Sep. 17, 2019

(54) MODULE FOR INSTALLATION IN A HEARING AID

(71) Applicant: Sivantos Pte. Ltd., Singapore (SG)

(72) Inventors: Erwin Singer, Eckental (DE); Christian Schmitt, Grossenseebach (DE); Benjamin Schmidt, Roethenbach an der Pegnitz (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/971,532

(22) Filed: May 4, 2018

(65) Prior Publication Data

US 2018/0324534 A1 Nov. 8, 2018

(30) Foreign Application Priority Data

May 4, 2017 (DE) ..... 10 2017 207 528

(51) Int. Cl.
*H04R 25/00* (2006.01)
*H04R 25/02* (2006.01)

(52) U.S. Cl.
CPC ..... *H04R 25/60* (2013.01); *H04R 25/02* (2013.01); *H04R 25/604* (2013.01); *H04R 25/652* (2013.01); *H04R 25/658* (2013.01); *H04R 25/552* (2013.01); *H04R 25/554* (2013.01); *H04R 2225/023* (2013.01)

(58) Field of Classification Search
CPC .. H04R 25/608; H04R 25/604; H04R 25/658; H04R 25/02; H04R 25/652; H04R 25/552; H04R 2225/023; H04R 25/554
USPC ..... 381/322
See application file for complete search history.

(56) References Cited

U.S. PATENT DOCUMENTS

| | | | | |
|---|---|---|---|---|
| 4,447,677 | A * | 5/1984 | Miyahra | H04R 25/456 381/323 |
| 4,739,512 | A * | 4/1988 | Hartl | H04R 25/65 381/324 |
| 5,887,070 | A * | 3/1999 | Iseberg | H04R 1/1016 181/130 |
| 8,098,866 | B2 * | 1/2012 | Gommel | H04R 1/1016 381/313 |
| 9,253,582 | B2 | 2/2016 | Nikles et al. | |
| 9,467,761 | B2 * | 10/2016 | Grinker | H04R 1/1058 |
| 2009/0123015 | A1 * | 5/2009 | Saltykov | H04R 25/604 381/328 |

(Continued)

FOREIGN PATENT DOCUMENTS

DE 10 2014 200 524 A1 7/2015

*Primary Examiner* — Oyesola C Ojo
(74) *Attorney, Agent, or Firm* — Muncy, Geissler, Olds & Lowe, P.C.

(57) ABSTRACT

A module for installation in a housing of a hearing aid, comprising a receiver having a first sound opening, for emitting acoustic signals, and an acoustic channel for guiding sound, which is aligned with the first sound opening and runs in a longitudinal direction. The acoustic channel is enclosed by a cup-shaped holder, and the holder has a second sound opening, which is aligned with the acoustic channel. The holder carries a spout, which has a mounting end and a connecting piece for connecting an ear mold. The spout has a channel for conducting sound, which runs in the longitudinal direction and is disposed in alignment with the second sound opening of the holder.

16 Claims, 5 Drawing Sheets

(56) References Cited

U.S. PATENT DOCUMENTS

| | | | | |
|---|---|---|---|---|
| 2009/0202097 | A1* | 8/2009 | Tiscareno | H04R 1/1016<br>381/380 |
| 2009/0316944 | A1* | 12/2009 | Tiscareno | H04R 1/2896<br>381/346 |
| 2010/0111348 | A1* | 5/2010 | Tsao | H04R 1/1016<br>381/380 |
| 2011/0034218 | A1* | 2/2011 | Sung | H04R 1/2842<br>455/569.1 |
| 2011/0311070 | A1* | 12/2011 | Epping | H04R 1/1016<br>381/74 |
| 2013/0148830 | A1 | 6/2013 | Sakaguchi | |
| 2015/0146900 | A1* | 5/2015 | Vonlanthen | H01Q 1/273<br>381/322 |
| 2015/0382094 | A1 | 12/2015 | Grinker et al. | |
| 2016/0094904 | A1* | 3/2016 | Yuen | H04R 1/1016<br>381/380 |

* cited by examiner

MODULE FOR INSTALLATION IN A HEARING AID

This nonprovisional application claims priority under 35 U.S.C. § 119(a) to German Patent Application No. 10 2017 207 528.7, which was filed in Germany on May 4, 2017, and which is herein incorporated by reference.

BACKGROUND OF THE INVENTION

Field of the Invention

The present invention relates to a module for installation in a housing of a hearing aid as well as a hearing aid having a module of this type.

Description of the Background Art

People who suffer a hearing impairment usually use a hearing aid. An ambient sound is usually detected with the aid of an electromechanical acoustic transducer. The detected electrical signals are processed with the aid of an amplifier circuit and introduced into the ear canal of the person with the aid of another electromechanical transducer. Different types of hearing aids are known. The so-called "behind-the-ear devices" are worn between the cranium and the outer ear. The amplified acoustic signal is introduced into the ear canal with the aid of an acoustic tube. Another customary design of a hearing aid is an "in-the-ear device," in which the hearing aid itself is introduced into the ear canal. As a result, the ear canal is at least partially closed by this hearing aid, so that, apart from the acoustic signals generated by the hearing aid, no additional sound is able to penetrate the ear canal—or only to a greatly diminished degree.

An ITE hearing aid is known from DE 10 2014 200 524 A1, which corresponds to U.S. Pat. No. 9,253,582, and which includes a receiver, a coil core forming an acoustic channel, and an antenna disposed on the coil core for installation in a housing of the hearing aid. In this design, it is necessary, when assembling the remaining components of the hearing aid, for these components to be glued together individually with a great degree of assembly complexity. Contamination due to adhesive on the components may easily occur. Due to the gluing of the components, it is impossible to service or repair the hearing aid. It has furthermore been shown that the antenna may easily become damaged.

SUMMARY OF THE INVENTION

It is therefore an object of the present invention to provide a particularly suitable module for a hearing instrument and a particular suitable hearing aid, which overcome the disadvantages of the prior art and are preferably universally usable for different types of hearing aids.

In an exemplary embodiment, a module is provided for installation in a housing of a hearing instrument, comprising a receiver having a first sound opening for emitting acoustic signals and an acoustic channel for conducting sound, which is aligned with the first sound opening and runs in a longitudinal direction, the acoustic channel being enclosed by a cup-shaped holder, and the holder having a second sound opening aligned with the acoustic channel, the holder carrying a spout having a mounting end and a connecting piece for connecting an ear mold, the spout having a channel for conducting sound, which runs in the longitudinal direction and which is disposed in alignment with the second sound opening of the holder.

In other words, the module for installation in the housing of the hearing aid comprises the receiver, the sound channel enclosed by the holder and the spout. Acoustic signals may be transmitted through a first sound opening in the receiver into the sound channel running in the longitudinal direction. The sound channel preferably has a linear design. On the side of the sound channel facing away from the receiver, a base of the cup-shaped holder limits the sound channel in the longitudinal direction. The base of the cup-shaped holder is situated at a distance from the receiver. The second sound opening is situated in the base of the holder. The holder carries the spout covering the second sound opening, including the channel for conducting sound, which is oriented in the longitudinal direction. The first sound opening, the acoustic channel, the second sound opening and the channel for conducting sound are disposed in alignment with each other.

For example, the spout is made from a metal, in particular a steel, such as high-grade stainless steel. The spout is preferably provided with a rotation-symmetrical design, in particular for the course of the acoustic channel. It is advantageously fastened to the holder on one mounting end of the spout. An ear mold may be suitably fastened to a connecting piece of the spout. A tubular part of the ear mold may be preferably pushed over the connecting piece. For example, the ear mold is fastened, in particular detachably, to the connecting piece in the assembly state.

In an embodiment, the connecting piece of the spout has a spherical bulge or is formed with the aid thereof. The spout or the connecting piece is, in particular, a so-called ball spout.

In an embodiment, which reduces assembly complexity, the acoustic channel is formed with the aid of the holder.

The holder can be manufactured from a plastic. Cost-effective manufacturing methods may be used hereby, in particular a manufacture by injection molding. For example, during assembly, the spout is at least partially overmolded by the plastic forming the holder. In other words, the holder is injection-molded onto the spout.

For example, the hearing instrument is a set of headphones or comprises a set of headphones. In particular, the hearing instrument is, however, a hearing aid. The hearing aid is used to support a person suffering a hearing impairment. In other words, the hearing aid is a medical device, with the aid of which, for example, a partial hearing loss is compensated for. The hearing aid is, for example, a "receiver-in-the canal" (RIC) hearing aid, an in-the-ear hearing aid, an "in the canal" (ITC) hearing aid or a "completely-in-canal" (CIC) hearing aid, an eyeglass hearing aid, a pocket hearing aid, a bone conduction hearing aid or an implant. The hearing aid is particularly preferably a behind-the-ear hearing aid, which is worn behind an outer ear. During operation, acoustic signals advantageously detected with the aid of the receiver are output and conducted with the aid of the acoustic channel into the ear of the person suffering a hearing impairment. For example, the part of the housing accommodating the receiver is at least partially disposed in an ear canal of the person. In the state for which it was designed, the spout is, for example, situated deeper in the ear canal than the receiver.

The acoustic channel can be formed with the aid of a hollow cylindrical support. The hollow cylindrical support facilitates an effective conduction of the sound from the receiver to the spout. The support is suitably at least partially, in particular completely, disposed within the cup-shaped holder. For example, the base of the cup-shaped holder has an annular projection, which points in the direction of the receiver. The support is suitably mounted on the projection, for example in a form-fitting and/or force-fitting manner. The projection has, in particular, a bead-shaped design.

An acoustic seal can be disposed between the holder and the support. The acoustic seal prevents a coupling in of interfering ambient sounds into the acoustic channel. The seal may be designed to be integral with the holder. Alternatively, the seal is a separate component. The seal is suitably formed with the aid of the projection, if the latter is present.

The holder can be non-detachably connected to the support, preferably glued thereto. This ensures that the holder and support remain connected to each other during assembly and use of the module in the hearing instrument. If the seal is present, the latter is preferably at least partially, in particular completely, formed with the aid of the adhesive. Alternatively, the seal is at least partially formed with the aid of the projection, if the latter is present. A penetration of the adhesive into the acoustic channel, in particular into the interior of the support, is suitably prevented with the aid of the projection.

The mounting end of the spout is advantageously at least partially enclosed by the holder, the mounting end of the spout being, in particular, notched. A stable connection between the holder and the spout is achieved by the partial enclosure of the mounting end of the spout. An undesirable sound exit is also prevented. A change in the position of the spout with respect to the holder is ruled out with the aid of the notching.

The receiver can have a cuboid design. For example, the receiver can be disposed transversely to the acoustic channel. The receiver is also oriented transversely to the support, if the latter is present. The main extension of the receiver is perpendicular to the course of the acoustic channel. The extension of the receiver transverse to the acoustic channel is thus greater than the extension of the receiver in the acoustic channel direction. In summary, the receiver has a greater spatial extension transversely than in parallel to the acoustic channel. The transverse direction of the receiver effectuates a space-saving arrangement of the receiver and acoustic channel, whose total length is reduced by the transverse arrangement of the receiver. A better use of space in the tapering part of the housing also results. The first sound opening in the receiver is suitably essentially disposed centrally on the side facing the holder.

A supporting plate, which is abutted by the receiver and which is disposed perpendicularly or substantially perpendicularly to the support, is advantageously connected to the support, in particularly formed thereon. The supporting plate is formed in an overwhelmingly planar manner and oriented transversely to the direction of the acoustic channel. The receiver is particularly easy to mount on the supporting plate. For example, the receiver is connected, in particular fastened, to the support.

The support and supporting plate can be designed, for example, as a single piece or as two separate components which are connected to each other. The supporting plate preferably has an additional sound opening, which is aligned with the acoustic channel. The acoustic channel advantageous extends through the supporting plate. In particular, the supporting plate is used to shield the receiver.

An antenna carried by the support can be arranged between the holder and the support. In particular, it is an induction antenna, preferably an antenna for transmitting data between two binaural hearing aids. The antenna is made up of, for example, a painted enameled wire, such as a copper enameled wire.

The supporting plate and/or the support can be formed from a ferrite material. The supporting plate formed from a ferrite material shields the receiver against the antenna or the antenna against the receiver. The support formed from a ferrite material acts as a coil core for the antenna.

The holder can have a male thread. The male thread makes it possible to easily and reversibly mount the module in a housing of a hearing instrument. The housing advantageously has a female thread, which corresponds to the male thread. In one alternative, the module and the housing are engaged.

Provided also is a hearing aid, in particular a CIC hearing aid, comprising a housing and a module described above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
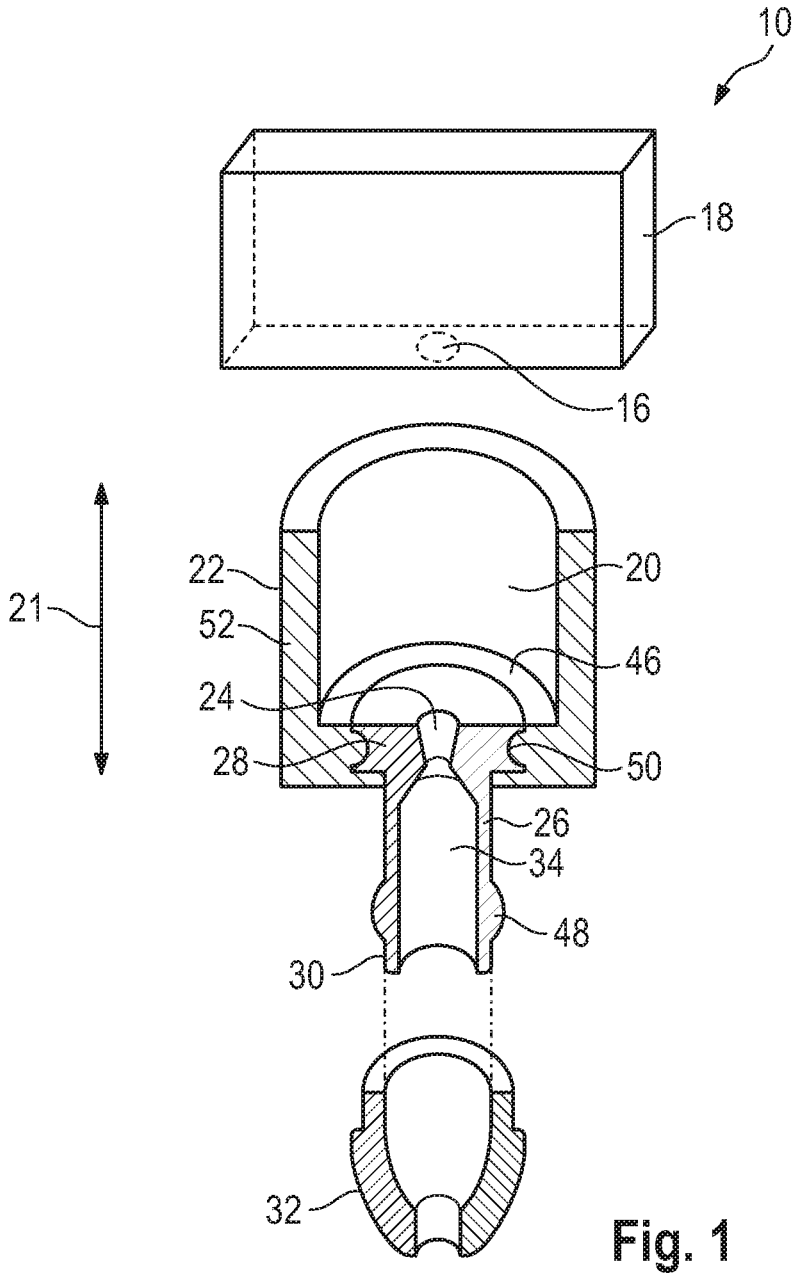
FIG. 1 shows a cross section of a module of a first exemplary embodiment.

In FIG. 1, a first exemplary embodiment is represented in a cross-sectional view of module 10. Module 10 comprises a receiver 18, a cup-shaped holder 22 and a spout 26.

In FIG. 1, receiver 18 is shown at a distance from holder 22 for better clarity. Receiver 18 and holder 22 are connected to each other in assembled module 10.

Receiver 18 has a first sound opening 16, through which it emits acoustic signals during operation. First sound opening 16 is essentially disposed in the center on the side of receiver 18 facing holder 22. If necessary, first sound opening 16 may also be disposed in a laterally offset manner.

Cup-shaped holder 22 encloses an acoustic channel 20, which is preferably cylindrical. Acoustic channel 20 is oriented in a longitudinal direction 21 and is closed by a base 46 of cup-shaped holder 22 on its side facing away from receiver 18. Base 46 of holder 22 has a second sound opening 24. Acoustic channel 20 preferably runs in a straight line. Cup base 46 is disposed at a distance from receiver 18.

Alternatively to the cylindrical shape illustrated, holder 22 may have a tapering design or another ergonomic shape.

Holder 22 is manufactured from plastic. Holder 22 may be particularly efficiently manufactured by injection molding.

Receiver 18 is oriented transversely to acoustic channel 20. The extension of receiver 18 in the transverse direction, which is perpendicular to longitudinal direction 21, is greater than its extension in longitudinal direction 21. The main extension of receiver 18 preferably extends perpendicularly to the course of acoustic channel 20.

If necessary, receiver 18 may also be disposed at an incline to the course of acoustic channel 20, for example at an angle of 5, 10, 15 or 20 degrees.

Spout 26 is fastened to base 46 of holder 22 on a mounting end 28. Spout 26 is manufactured from a metallic material or a plastic. In particular, the spout is a ball spout.

In the example illustrated in FIG. 1, a notched mounting end 28 of spout 26 is partially enclosed by holder 22. Notching 50 of mounting end 28 is U-shaped; alternatively notching 50 may be V-shaped. Mounting end 28 is embedded into holder 22 in such a way that the side of mounting end 28 facing acoustic channel 20 is exposed. All other sides of mounting end 28 are covered by the material of holder 22. In another specific embodiment, mounting end 28 could also be completely enclosed by holder 22.

The enclosure of mounting end 28 is preferably carried out by injection molding. In another variant, mounting end 28 of spout 26 is snapped into a recess of holder 22.

Alternatively spout 26 is fastened to holder 22 on the side thereof facing away from acoustic channel 20, for example by gluing.

Also, the holder 22 and spout 26 can be integrally formed.

Spout 26 also includes a connecting piece 30, to which an ear mold 32 may be fastened. Connecting piece 30 illustrated in FIG. 1 has a spherical, outwardly projecting or bead-shaped bulge 48, which prevents ear mold 32 from slipping. Alternatively, connecting piece 30 may have a linear, conical or corrugated design.

Spout 26 has a rotation-symmetrical design, in particular with respect to the course of acoustic channel 20, and has a channel for conducting sound 34, which runs in longitudinal direction 21.

Channel for conducting sound 34, second sound opening 24, acoustic channel 20 and first sound opening 16 are aligned with each other to facilitate a conduction of sound from receiver 18 to ear mold 32.

Figure 2:
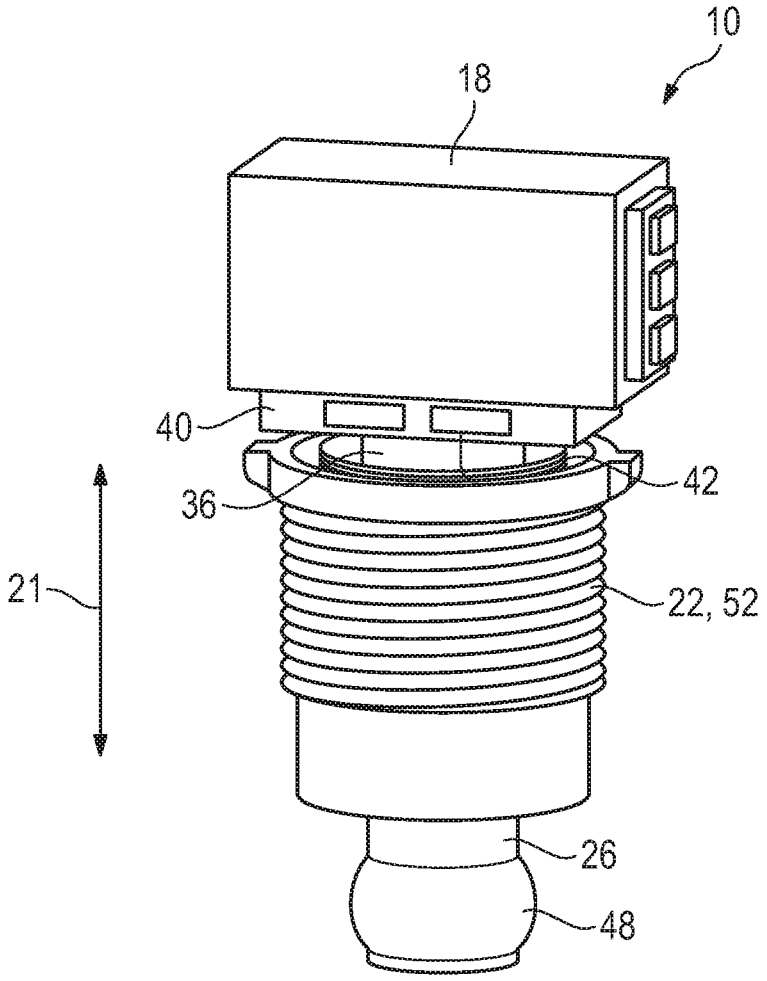
FIG. 2 shows a top view of a module of a second exemplary embodiment.
Figure 3:
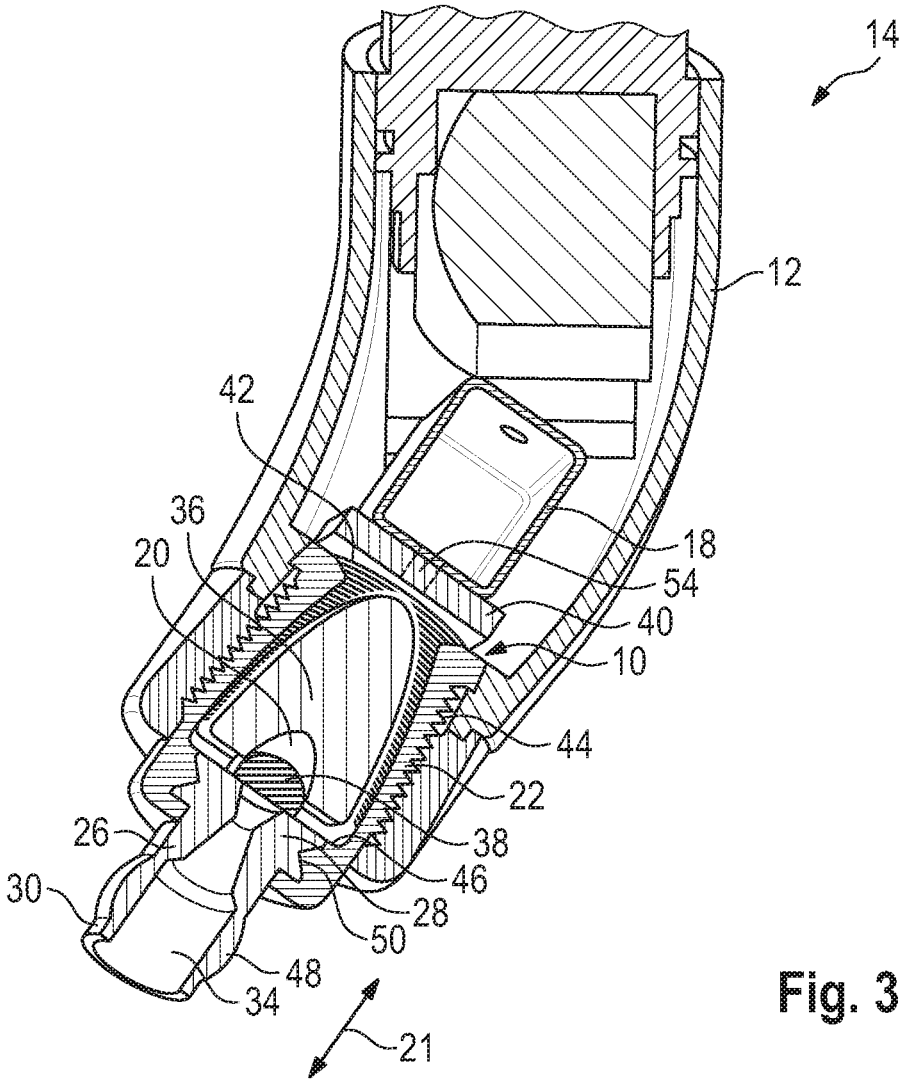
FIGS. 3 and 4 show a cross section of a hearing aid.

A top view of module 10 is illustrated in FIG. 2, and a sectional representation thereof is illustrated in FIG. 3. In addition to the components of the first exemplary embodiment described under FIG. 1, to which reference is hereby made, the second exemplary embodiment includes a supporting plate 40 and a support 36. The second exemplary embodiment may furthermore include an antenna 42 (FIG. 3). An antenna-free variant of the exemplary embodiment is also possible. One variant, which is not illustrated, does not have an antenna 42.

Support 36 is a hollow cylinder, which at last partially forms acoustic channel 20 and is enclosed for the most part by a cup wall 52 of cup-shaped holder 22. Acoustic channel 20 thus runs in support 36. Support 36 preferably extends up to base 46 of cup-shaped holder 22; in particular, support 36 abuts base 46.

An acoustic seal 38 is disposed between holder 22 and support 36, which shields acoustic channel 20 against interfering noise.

Supporting plate 40 is formed in a planar manner and oriented transversely to the direction of acoustic channel 20. An additional sound opening 54, situated in supporting plate 40, is aligned with acoustic channel 20.

Support 36 and supporting plate 40 are designed as a single piece. Alternatively, support 36 and supporting plate 40 may have a two-part design. supporting plate 40 is oriented perpendicularly to support 36.

If necessary, supporting plate 40 may also be disposed at an incline to the course of support 36, for example at an angle of 5, 10, 15 or 20 degrees.

Receiver 18 is fastened to supporting plate 40. Receiver 18 and supporting plate 40 are disposed in such a way that first sound opening 16 of receiver 18 and additional sound opening 54 of supporting plate 40 are aligned with each other and with acoustic channel 20 to facilitate a sound conduction to ear mold 32.

Antenna 42 is a coil extending in longitudinal direction 21 and thus oriented transversely to receiver 18. Antenna 42 is mounted on the lateral surface of support 36, so that antenna 42 is situated between holder 22 and support 36. Cup wall 52 of holder 22 encloses antenna 42 for the most part. Holder 22 protects antenna 42 against damage.

Supporting plate 40 separates receiver 18 from antenna 42 and shields it against antenna 42. The shielding is particularly effective if supporting plate 40 is manufactured from a ferrite material. Supporting plate 40 is disposed transversely to antenna 42 and disposed a short distance from the coil core thereof. Support 36 manufactured from a ferrite material acts as a coil core for antenna 42, whose transmitting and receiving power are improved thereby.

Holder 22 is a separate, injection-molded plastic part. Alternatively, holder 22 and support 36 are a composite part, in which holder 22 was manufactured by overmolding support 36. Holder 22 and support 36 are then non-detachably connected to each other. As appropriate, seal 38 is integrated into the composite part. Alternatively, holder 22 and support 36 are connected to each other by gluing.

Figure 4:
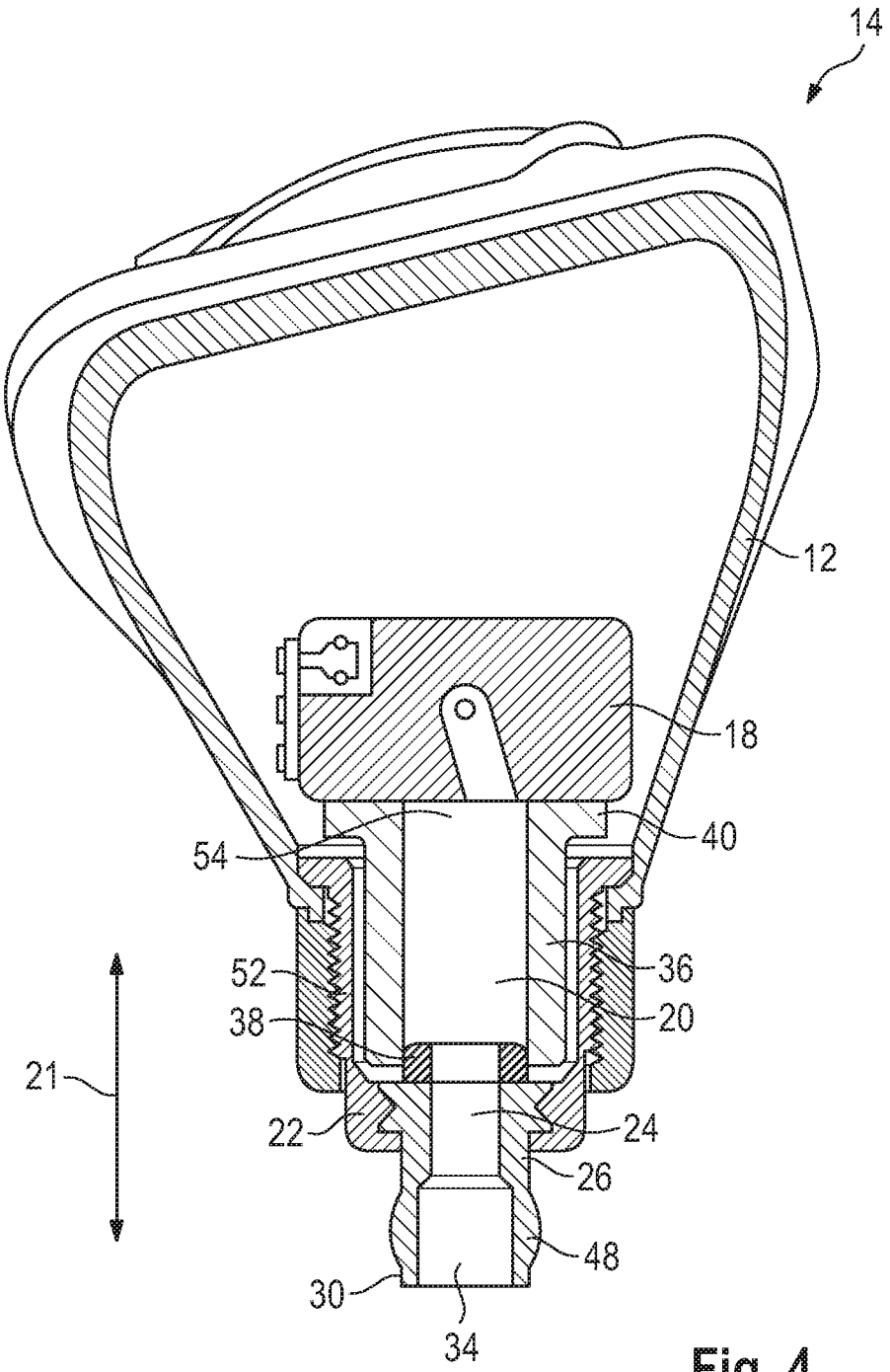

FIGS. 3 and 4 show a cross section of a hearing aid 14, including module 10 according to FIG. 2 mounted therein.

Holder 22 has a male thread 44. Male thread 44 permits an easy, detachable fastening of module 10 in a housing 12 of hearing aid 14.

The transverse orientation of receiver 18 effectuates space-saving arrangement of receiver 18 and antenna 42, so that the total length of module 10 in longitudinal direction 21 is reduced. The transverse arrangement of receiver 18 also results in a better use of space in the tapering part of housing 12. The space available in the tapering tip of housing 12 is thus better utilized than would be the case with a lengthwise-oriented receiver 18. If the sound exit of housing 12 does not take place linearly with acoustic channel 20 in antenna 42, a bent, premolded acoustic tube of an ear mold 32 may be connected to connecting piece 30 of spout 26.

Figure 5:
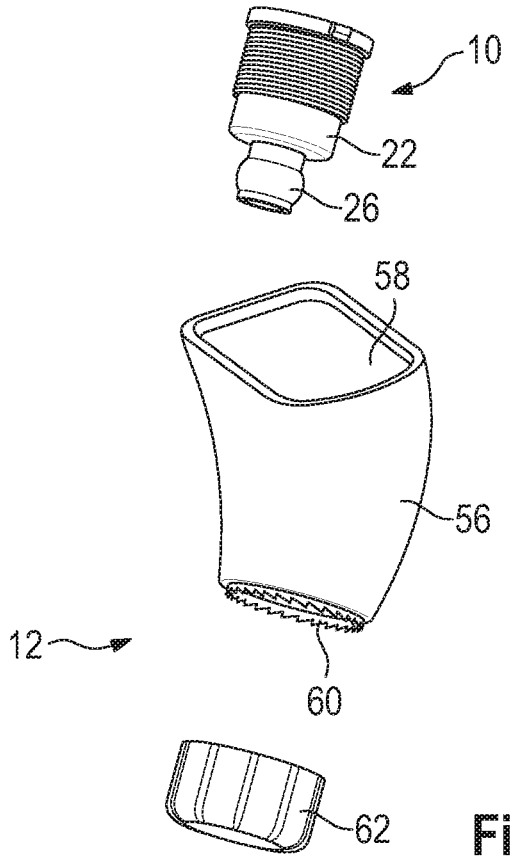
FIGS. 5 and 6 show the assembly of the hearing aid.
Figure 6:
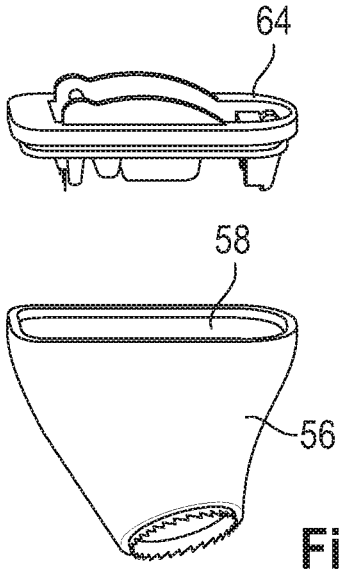

The assembly of hearing aid 14 is illustrated in FIG. 5. For this purpose, module 10 is inserted through a first opening 58 into a first housing part 56, which has an essentially conical design. Module 10 is moved through first housing part 56 until spout 26 and one part of holder 22 project through a second opening 60. A passage through first housing part 56 is prevented on the basis of a stop of first housing part 56, against which holder 22 rests, as intended, in the assembled state. Opening 58 is closed with the aid of holder 22. A second housing part 62 is subsequently placed onto second opening 60, where it is screwed or engaged with the male thread of holder 22. As a result, module 10 is fixed between the two housing parts 56, 62. The first opening is subsequently closed with the aid of a cover 64 illustrated in FIG. 6, which includes a control element for adjusting hearing aid 14.

The invention is not limited to the exemplary embodiments described above. Instead, other variants of the invention may be derived herefrom by those skilled in the art without going beyond the subject of the invention. Moreover, in particular, all individual features described in connection with the individual exemplary embodiments may also be otherwise combined with each other without going beyond the subject of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A module for installation in a housing of a hearing instrument, the module comprising:

a receiver having a first sound opening for emitting acoustic signals;

an acoustic channel for guiding sound, which is aligned with the first sound opening and runs in a longitudinal direction; and a cup-shaped holder enclosing at least a portion of the acoustic channel, the holder having a second sound opening, which is aligned with the acoustic channel, and the holder having an upper end that opposes a bottom surface of the receiver and a lower end having a base wall that extends perpendicular to the longitudinal direction, the second sound opening extending through the base wall, wherein the holder is attached to a spout, an upper end of the spout being a mounting end that is at least partially embedded inside the base wall of the holder and a lower end of the spout being a connecting piece that connects to an ear mold, and wherein the spout has a channel for conducting sound, which runs in the longitudinal direction and is disposed in alignment with the second sound opening of the holder.

2. The module according to claim 1, wherein the acoustic channel is formed with the aid of a hollow cylindrical support.

3. The module according to claim 2, wherein an acoustic seal is disposed between the holder and the support.

4. The module according to claim 2, wherein the holder is non-detachably connected or glued to the support.

5. The module according to claim 1, wherein the mounting end of the spout has a notched portion, the notched portion being embedded inside the base wall of the holder.

6. The module according to claim 1, wherein the receiver is disposed transversely to the acoustic channel that runs in the longitudinal direction, such that an extension of the receiver in a transverse direction, which is perpendicular to the longitudinal direction, is greater than an extension of the receiver in the longitudinal direction.

7. The module according to claim 2, wherein a supporting plate is connected or formed on the support, and wherein the supporting plate is abutted by the receiver and which is disposed substantially perpendicularly to the support.

8. The module according to claim 2, wherein an antenna is carried by the support and is disposed between the holder and the support.

9. The module according to claim 7, wherein the supporting plate and/or the support is/are formed from a ferrite material.

10. The module according to claim 1, wherein the holder has a male thread.

11. A hearing aid comprising a housing and a module according to claim 1.

12. The module according to claim 1, wherein the hearing instrument is a hearing aid.

13. The hearing aid according to claim 11, wherein the hearing aid is a completely-in-canal (CIC) hearing aid.

14. The module according to claim 1, wherein an exterior surface of the connecting piece has a bead-shaped bulge thereon to connect to the ear mold.

15. The module according to claim 1, wherein the mounting end of the spout is narrower than the lower end of the holder.

16. The module according to claim 1, wherein the mounting end of the spout is at least partially embedded inside the base wall of the holder, such that the base wall of the holder protrudes radially from the spout.

* * * * *